US006409903B1

(12) United States Patent
Chung et al.

(10) Patent No.: US 6,409,903 B1
(45) Date of Patent: Jun. 25, 2002

(54) MULTI-STEP POTENTIOSTATIC/ GALVANOSTATIC PLATING CONTROL

(75) Inventors: Dean S. Chung, Essex Junction; Josef W. Korejwa, Charlotte; Erick G. Walton, Underhill, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/469,120

(22) Filed: Dec. 21, 1999

(51) Int. Cl.[7] ..... C25D 5/00; C25D 5/18; C25D 7/12; C25D 17/00

(52) U.S. Cl. ..... 205/96; 205/105; 205/157; 205/291; 204/229.5; 204/DIG. 9; 204/FOR 922

(58) Field of Search ..... 205/105, 102, 205/96, 159, 157, 291, 104; 204/FOR 922, FOR 927, 229.6, 230.6, 229.5, DIG. 7, DIG. 9; 438/405, 758; 428/450, 689

(56) References Cited

U.S. PATENT DOCUMENTS 2,951,978 A * 9/1960 Dickson et al. ..... 322/6
4,906,346 A 3/1990 Hadersbeck et al. ..... 204/238
5,352,350 A 10/1994 Andricacos et al. ..... 205/101
5,443,707 A 8/1995 Mori ..... 204/242
5,958,207 A * 9/1999 Mull ..... 205/104
5,985,126 A * 11/1999 Bleck et al. ..... 205/123
6,074,544 A * 6/2000 Reid et al. ..... 205/157
6,159,354 A * 12/2000 Contolini et al. ..... 205/96

OTHER PUBLICATIONS

Lowenheim, "Electroplating", pp. 143–144, c. (no month available) 1978.*

* cited by examiner

*Primary Examiner*—Edna Wong
(74) *Attorney, Agent, or Firm*—DeLio & Peterson, LLC; John J. Tomaszewski; Richard M. Kotulak

(57) ABSTRACT

A method and apparatus are provided for the electroplating of a substrate such as a semiconductor wafer which provides a uniform electroplated surface and minimizes bum-through of a seed layer used on the substrate to initiate electroplating. The method and apparatus of the invention uses a specially defined multistep electroplating process wherein, in one aspect, a voltage below a predetermined threshold voltage is applied to the anode and cathode for a first time period followed by applying a current to the anode and cathode for a second time period the current producing a voltage below the predetermined threshold voltage. In another aspect of the invention, a current is applied to the anode and cathode substrate which current is preprogrammed to ramp up to a current value from a first current value which current produces a voltage below a predetermined threshold voltage. Electroplated articles including copper electroplated semiconductor wafers made using the apparatus and method of the invention are also provided.

18 Claims, 2 Drawing Sheets

MULTI-STEP POTENTIOSTATIC/ GALVANOSTATIC PLATING CONTROL

BACKGROUND OF THE INVENTION

1. Field of the Invention

This invention relates to an electroplating apparatus and method for the electrodeposition of a metal onto a substrate immersed in an electroplating bath and, more particularly, to the electroplating of copper onto semiconductor wafers which copper plating is relatively uniform and minimizes bum-through of a seed layer on the wafer used to initiate the electroplating.

2. Description of Related Art

Industrial chemists have devised many applications for electroplating of metals onto various substrates. They typically adopt a simple, direct-current (DC) power supply which is designed to maintain a constant-current. This is the so-called galvanostatic mode of electroplating, in which the potential across the anode and cathode in the plating cell varies in order to maintain the current level. Such a mode of control is obviously beneficial if the quality of the coating is optimized by the selected current density and, perhaps, if high throughputs are desired. Although more complex waveforms have been devised to apply either a simple DC-pulse (square waveform) or a set of alternating pulses (combination of square waveforms having alternating polarity), these applications have been much more specialized and have been less widely adopted in common industrial applications.

The use of complex potential-and/or current-step waveforms have also been used in academic research. For example, electrochemists have employed potential step and current step methods as analytical tools to characterize the kinetics of redox reactions. In potential step experiments, the potential is adjusted to different levels to probe the different regimes of electroactivity of the species involved. Such methods have proven effective at characterizing redox systems under mass-transport limiting conditions. Current step techniques have been used to study rapid and quasi-reversible electrode reactions. Double-layer capacitance information can also be gained from these methods. Both potential step and current step methods have been especially useful when investigating complex, multicomponent electrode systems.

SUMMARY OF THE INVENTION

The present invention employs certain aspects of such aforementioned current and potential "step" waveforms to overcome serious manufacturing defects encountered in volume production of electroplated substrates covered by a thin film of the appropriate metallic "seed layer", where such seed layers are typically less than 0.2 microns thick. Such defects, hereafter referred to as "bum through", represent local thickness inhomogeneities in the thin seed layer that are a result of an attempt to inject electrical current into the thin, metal seed layer using discrete point contacts.

Bearing in mind the problems and deficiencies of the prior art, it is therefore an object of the present invention to provide a multistep electroplating process for wafers and other substrates which provides a uniform electroplated substrate and minimizes burn-through of a seed layer on the substrate used to initiate plating.

It is another object of the present invention to provide an apparatus for electroplating which provides a uniform metal plating onto a substrate and which minimizes burn-through of a seed layer on the substrate used to initiate the electroplating.

A further object of the invention is to provide electroplated articles including copper plated semiconductor wafers made using the apparatus and method of the invention.

Still other objects and advantages of the invention will in part be obvious and will in part be apparent from the specification.

The above and other objects and advantages, which will be apparent to one of skill in the art, are achieved in the present invention which is directed to, in a first aspect, a multistep electroplating process for electroplating a seed layer containing substrate such as a semiconductor wafer with copper or other metal comprising the steps of:

- inserting a substrate having a seed layer to initiate metal plating thereon into an electroplating apparatus comprising a metal plating solution, an anode and multiple cathode electrical perimeter contacts to the seed layer;
- exposing the seed layer, anode and the perimeter contacts to the metal plating solution;
- plating onto the seed layer and substrate by applying to the anode and perimeter contacts for a first time period a voltage, preferably constant, below a predetermined threshold voltage; and
- continuing the plating onto the plated substrate by applying after the first time period a current, preferably constant, to the anode and perimeter contacts for a second time period the current producing a voltage below the predetermined threshold voltage.

In another aspect of the invention a multistep electroplating process for plating a seed layer containing substrate such as a semiconductor wafer with copper or other metal is provided comprising the steps of:

- inserting a substrate having a seed layer to initiate metal plating thereon into an electroplating apparatus comprising a metal plating solution, an anode and multiple cathode electrical perimeter contacts to the seed layer;
- exposing the seed layer, anode and perimeter contacts to the metal plating solution; and
- plating onto the seed layer and substrate by applying to the anode and perimeter contacts a current preprogrammed to ramp up to a current value, preferably constant, from a first current value which current produces during the ramping a voltage below a predetermined threshold voltage.

In another aspect of the invention, an apparatus for electroplating a seed layer containing substrate such as a semiconductor wafer with copper or other metal which is immersed in an electroplating bath comprises:

- a tank containing a metal plating solution;
- an anode in the metal plating solution;
- a cathode substrate positioned in the electrolyte having a seed layer thereon facing the anode, the seed layer having multiple cathode perimeter electrical contacts;
- means for supplying a current to the anode and cathode in the apparatus to apply to the anode and perimeter contacts for a first time period a voltage, preferably constant, below a predetermined threshold voltage; and
- means for supplying after the first time period a current, preferably constant, to the anode and perimeter contacts for a second time period the current producing a voltage below the predetermined threshold voltage.

In another aspect of the invention, an apparatus for electroplating a seed layer containing substrate such as a semiconductor wafer with copper or other metal comprises:

- a tank containing a metal plating solution;

an anode in the metal plating solution;

a cathode substrate positioned in the electrolyte having thereon a seed layer facing the anode, the seed layer having multiple cathode perimeter electrical contacts; and means for supplying a current to the anode and perimeter contacts which current is preprogrammed to ramp up to a current value, preferably constant, from a first current value which current produces during the ramping a voltage below a predetermined threshold voltage.

In another aspect of the invention electroplated articles including metal (copper) plated semiconductor wafers are provided which are made using the apparatus and method of the invention.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(s)

Figure 1:
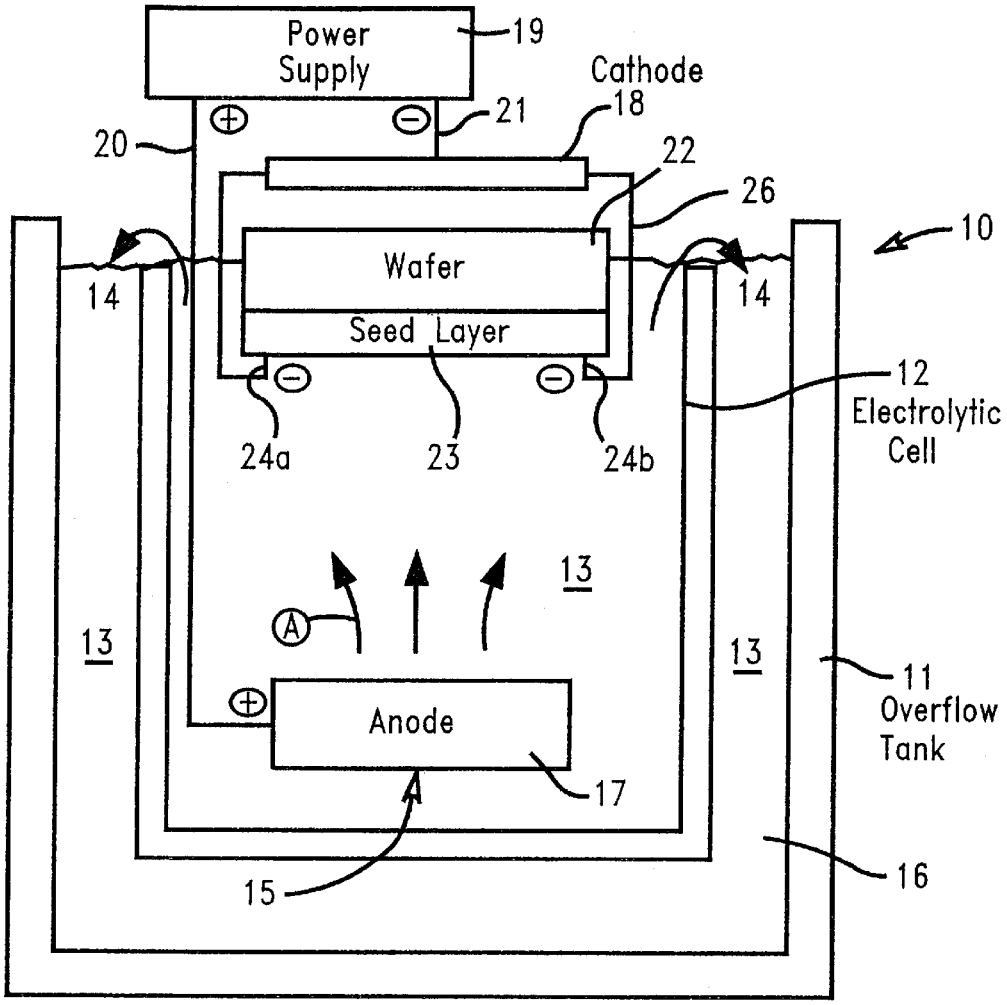
FIG. 1 (Prior Art)
FIG. 1 is a schematic illustration of an electrolytic plating apparatus showing an anode and a wafer cathode substrate having a copper seed layer with perimeter electrical contacts.

In describing the preferred embodiment of the present invention, reference will be made herein to FIGS. 1–5 of the drawings in which like numerals refer to like features of the invention. Features of the invention are not necessarily shown to scale in the drawings.

When copper plating a wafer substrate, a seed layer is usually used on the wafer surface to initiate plating. Unfortunately, a phenomenon known as "burn-through" may result where the applied current destroys the seed layer at the contact point causing non-symmetric plated copper deposits to form.

There are several approaches to eliminating this burn-through phenomenon. In one approach, the area of each contact is increased, e.g., from 0.50–0.8 $mm^2$ to over 3 $mm^2$, and, in addition, by shielding the non-contacting metallic surfaces so that the contact isn't directly exposed to the plating solution. However, this requires a reduction in the surface area of active seed layer which is available for metallization. Also, the presence of leakage currents may easily occur in production because seals designed to protect the electrical contacts from the plating solution are difficult to maintain. Such problems are expected to become worse as the applied plating currents are increased in an attempt to decrease plating time and improve the tool efficiencies.

Another possibility is increasing the number of contacts, thus reducing the current density at any given point of electrical contact and presumably decreasing V(p). This brings about much greater tool complexity and cost and is not a "fail-safe" design solution.

Also, for logic & microprocessor fabricators, wafers processed in the BEOL for copper metallization are expected to have high cost, and the potential for even low levels of scrap will increase manufacturing costs. Such increased scrap is expected to increase even more as seed layers are scaled lower in thickness, substrate diameter is scaled from 200 mm to 300 mm, and seed copper (bulk) resistivity may be sufficiently uncontrolled so as to contribute even further to the observed incidence of mild or catastrophic burn-through.

Referring first to FIG. 1, a typical electrolytic plating apparatus used to plate semiconductor wafers is shown generally as 10. The electrolytic plating apparatus is of the overflow type wherein electrolyte overflows the actual plating cell into a sump or other receiving vessel which electrolyte is then pumped or recycled back into the electrolytic cell establishing a continuous flow of electrolyte through the electrolytic cell. Similar type apparatus commonly termed a cup apparatus and the like may also be employed as well as a conventional apparatus employing only an electrolytic cell without an overflow. A cup apparatus is shown in U.S. Pat. No. 5,443,707 to Mori, which patent is hereby incorporated by reference.

The electrolytic plating apparatus shown in FIG. 1 comprises an outside overflow tank 11 and an inside electrolytic cell 12. The electrolytic cell 12 contains electrolyte 13 therein and as shown by arrows A, the electrolyte flows upward through cell 12 and overflows at electrolyte outlet 14. The overflow from electrolytic cell 12 is then contained in overflow tank 11 and is recycled back into cell 12 through electrolyte inlet 15 typically at the bottom of the electrolytic cell 12. The electrolyte 13 then flows upward through electrolytic cell 12 past anode 17 and across wafer 22 and seed layer 23 as it exits electrolytic cell 12 at outlet 14.

An anode 17 is shown positioned in the lower portion of electrolytic cell 12 and the wafer 22 having a seed layer 23 thereon is shown at the upper portion of the cell. A power supply 19 provides a positive terminal to anode 17 through line 20. The negative terminal is connected by line 21 to a cathode bar 18 which is connected to the seed layer 23 by peripheral cathode perimeter contacts 24*a* and 24*b*. There are typically numerous contacts, e.g., 6 or 8 on the surface of the seed layer 23, and two are shown in FIG. 1. Accordingly, when power supply 19 is activated a current is generated between anode 17 and seed layer 23 for electrodepositing the electrolyte metal onto the seed layer 23 surface. While any suitable metal electrolyte could be used, the following description will be directed to a copper electrolyte since this is the most important for plating interconnect wires on semiconductor wafers.

Constant current process control for electroplating semiconductor wafers is the industry standard approach because it results in a consistent mass plated film. The POR (process of record) constant current process may be described by reference to FIGS. 1 and 5 as follows:

1. The front side of the wafer to be electroplated as the cathode is physically contacted with metallic probes that are interconnected with a filtered, DC or pulsed AC power supply. For convenience, the following description will be directed to DC waveforms although it will be understood to those skilled in the art that other waveforms may be used. Contact is usually made at the wafer perimeter and the portion of the wafer to be plated (e.g. frontside) is already "seeded" with a thin layer of copper from a PVD or CVD sputter tool. The electrical probes must contact this seed layer and typically a minimum of six separate perimeter contacts are used to maintain good uniformity of applied current. The point contact area is approx. 0.2–0.5 $mm^2$ per contact pin.

2. The copper-seeded wafer and probes are placed in contact with the plating solution at time zero ("T0") in a plating apparatus containing an electrolyte including the cation of the metal to be plated and an anode.
3. Some time interval, ("DT1"), passes where the wafer remains in contact with the solution, but no voltage (current) is applied to the contacts.
4. The power supply is turned on at T1=T0+DT1. The electroplating apparatus is normally run in "constant current" mode. For example, if a DC current of 9.0 amps is applied on a 200 mm substrate, it results in an average current density of 30 $mA/cm^2$, assuming the wafer is perfectly smooth. If the plating head has been idle for more than 10–15 minutes before applying power, the voltage typically spikes to a high peak value, V(p), at the onset of plating ("T1") and then decays toward a steady-state value of voltage over time. Throughout this period, the current is maintained at 9.0 amps (or other nominal constant current). A sufficiently large voltage spike at the onset of plating usually causes burn-through of the seed layer at the points of electrical contact or the seed Cu being deplated from the vicinity of the contact, both of which result in scrapping of the wafer substrate.

Initiation of copper plating on a wafer substrate occurs when current is applied by perimeter contacts to a copper seeded wafer as shown in FIG. 1. Typically, the difference in potential across the anode and cathode V(cell), rises quickly due to the high sheet resistance of the thin, seed copper layer since sheet resistance is inversely proportional to film thickness. The need to apply large DC-potentials using a finite number of contact points also increases the probability of causing "burn-through", which is a phenomenon that may occur at the onset of copper electroplating on a seed layer containing substrate. "Burn-through" typically affects metal deposits near the point or points of electrical contact with the substrate as the cell voltage, V(cell), rises to drive the cell current, I(cell) to its predetermined specification. In mild occurrences, burn-through may simply cause non-symmetric plated copper deposits to form. In more severe cases, however, no electrodeposition occurs at the contact and in fact, the seed copper itself may be reduced in thickness or missing near the contact.

Since the simplest, and therefor most preferred productive plating is performed in a galvanostatic (constant current) mode, V(cell) may rise very rapidly to some "peak" value, V(p), as I(cell) also rises to its fixed, or target, specification. In galvanostatic plating, I(cell) remains constant but V(cell) typically peaks and then decays towards some steady-state value.

The decay in cell voltage from a peak value V(p) to reduced potential values is partly a result of the decreasing sheet resistance of the substrate itself, as the thickness of plated copper increases steadily.

It has been found that the probability of "burn-through" is nearly 100% if V(p) is higher than some threshold value, V(Th), which may be empirically determined for the plating apparatus configuration and bath chemistry of choice. It is also not a guaranteed solution to eliminate burn-through because the use of thinner seeds, larger substrates and degraded contacts due to oxide buildup, corrosion, etc. are expected to increase the probability that V(p) may exceed V(Th) at any given contact point. The threshold potential, V(Th), for burn-through is rather low; i.e. V(p)−V(Th) has been observed to be <1.0 volt for a plating head with six point contacts with point-contact areas of about 0.5–0.8 $mm^2$ each. Therefore, although increasing the number of contacts will decrease the probability of catastrophic burn-through at any given contact, it is expected to be very expensive to wire multitudinous contacts, in individual fashion, in a corrosive chemical environment, and it is not expected to eliminate the burn-through defect as product needs scale in the future.

Figure 2:
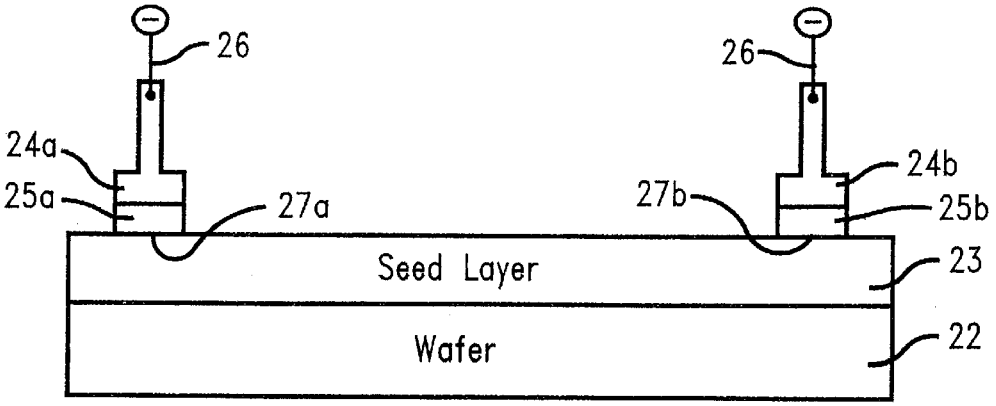
FIG. 2 (Prior Art)
FIG. 2 is an enlarged view of the wafer substrate and perimeter contacts of FIG. 1.

Referring now to FIG. 2, an enlarged view of wafer 22 and seed layer 23 of FIG. 1 is shown. Cathode perimeter contacts 24*a* and 24*b* are shown connected to electrical line 26 from the negative potential side of power supply 19. Typically, a copper oxide layer 25*a* and 25*b* will form between the surfaces of perimeter contacts 24*a* and 24*b* and the surface of seed layer 23. It is at point 27*a* and 27*b* of seed layer 23 where burn-through of the seed layer typically occurs as discussed hereinabove. As can be appreciated, burn-through of the seed layer is very serious and will cause, at best, non-uniform plating of the wafer surface and, at worst, a plating which is not commercially acceptable requiring that the wafer be discarded.

In another embodiment of the invention, seals, usually polymers, may be placed over the contact points 24*a* and 24*b* to avoid contact of the plating solution with the contact points and seed layer and further minimizing burn-through of the seed layer.

Figure 5:
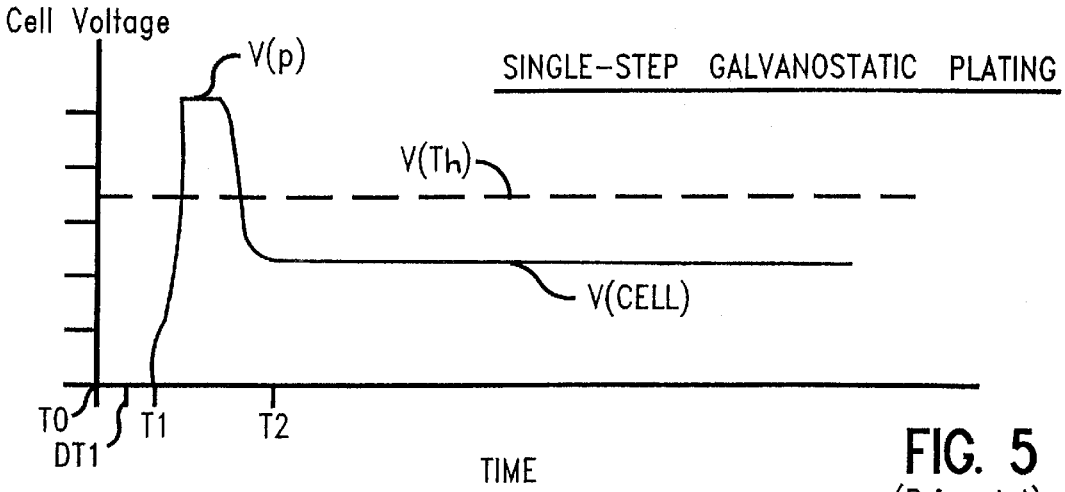
FIG. 5 (Prior Art)
FIG. 5 is a graph showing voltage vs time for a substrate immersed in an electroplating bath which is electroplated using a prior art electroplating method and apparatus.

Referring to FIG. 5, a graph of voltage vs. time is shown for a substrate immersed in an electroplating bath which is electroplated using a prior art electroplating method and apparatus. At time T0 a copper-seeded wafer and perimeter contacts are placed in contact with the plating solution. A time interval DT1 passes where the wafer remains in contact with the solution but no voltage (current) is applied to the contacts. The power supply is turned on at T1 which is equal to T0+DT1 and the electroplating apparatus is run in constant current mode as is conventional in the prior art. As can be seen from the graph, when the power supply is turned on, the voltage increases sharply to a peak value termed V(p). Also shown in the graph is a threshold voltage termed V(Th). The threshold voltage can be determined for a particular plating apparatus and substrate to be plated and is a value above which burn-through probably will result if exceeded. As shown in FIG. 5, the V(p) exceeds the V(Th) and burn-through will most likely result. After a certain time period T2, the voltage decreases to the steady state voltage of the cell termed V(cell). The cell was then run at this voltage which is also associated with a constant current until the substrate is plated. Operating the cell with this type power supply will most likely result in burn-through of the seed layer and the wafer will be ruined and must be discarded.

Figure 3:
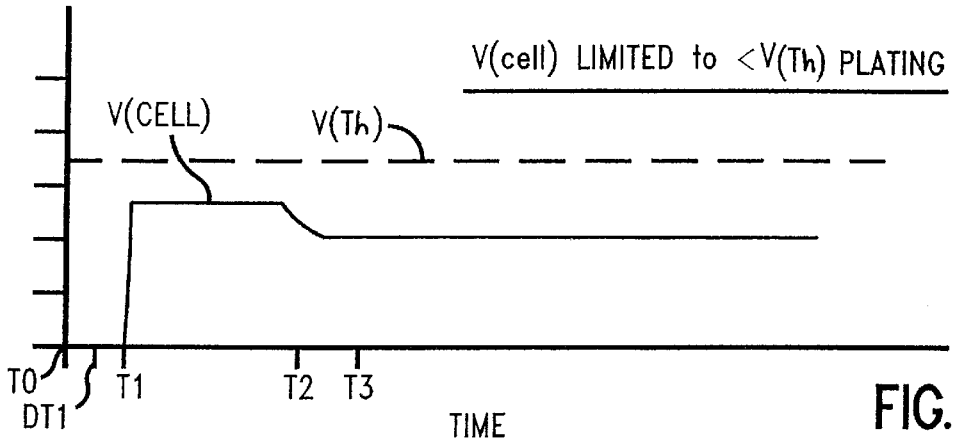
FIG. 3 is a graph showing voltage vs time for a substrate immersed in an electroplating bath and plated using a method and apparatus of one aspect of the invention.

Referring now to FIG. 3, a graph is shown of voltage vs. time for a substrate immersed in electroplating bath and plated using a method and apparatus of one aspect of the invention. Accordingly, the copper seeded wafer and probes are placed in contact with the plating solution at T0. At some time interval DT1 the wafer remains in contact with the solution but no voltage (current) is applied to the cell. When the power supply is turned on at T1, which is equal to T0+DT1, a voltage is applied to the cell V(cell) which is less than the V(Th) for the cell. The plating is continued until T2, at which time a constant current is applied to the cell for a second time period which constant current provides a voltage less than V(Th). Following a procedure as shown in FIG. 3 burn-through of the seed layer is minimized and typically eliminated.

Figure 4:
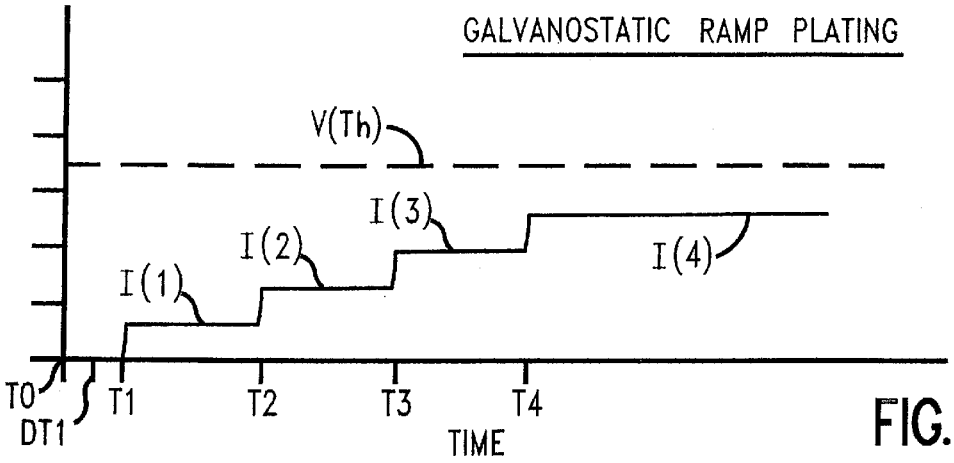
FIG. 4 is a graph showing voltage vs time for a substrate immersed in an electroplating bath and plated using a method and apparatus of another aspect of the invention.

In FIG. 4, which is another embodiment of the invention showing voltage vs. time, at T0 the copper seeded wafer and probes are placed in contact with the plating solution. When the power supply is turned on at T1 which is equal to T0+a time interval DT1, a particular current is used which is preprogrammed to ramp up to a constant current value from a first current value I(1) to I(4). Thus, at time T2 the current is increased to 1(2) and at time T3 the current is increased to I(3). At T4 the current is increased to its final desired current level I(4). Using this procedure of ramping the current from a low value to a high value, the threshold voltage V(Th) is not exceeded and there will be no detrimental burn-through of the seed layer of the wafer.

While the plating times shown in FIGS. 3 and 4 may vary widely, the times will usually be determined based on the wafer to be plated and the electrolyte used and operating temperature. Generally, the V(Th) will be determined for the particular substrate and electrolytic plating cell and this value will be used to determine the cell voltage to be used in the embodiment shown in FIG. 3 and the preprogrammed current ramping levels to be used as shown in FIG. 4.

V(Th) can be determined in a number of ways preferably by empirical means on the plating apparatus of interest. Typically, one runs a series of experiments using substrates having a seed layer thickness representative of the recipe under consideration, whereby the V(cell) is monitored at and immediately after the onset of plating under galvanostatic (constant current) conditions. Simple visual inspection of the wafer after completion of plating is usually sufficient to detect catastrophic "burn-through".

As an example of the process as shown in FIG. 3, a wafer 200 mm in diameter and coated with a copper seed layer of about 400 Angstroms thick was contacted with 6 peripheral cathode contacts and immersed into an electroplating cell. A process as shown in FIG. 3 was employed to plate the wafer and a V(cell) of 1.0V was used for 5 seconds. After this time at T2, the current was adjusted to the desired cell current of 4.5 amps providing a cell voltage V(cell) of about 1.4V. Plating was continued for 2.75 minutes and the plated wafer had a uniform copper plating and no burn-through of the seed layer.

Similarly for a wafer as in FIG. 3, as shown in FIG. 4, at T1 a copper seeded wafer was plated using the process as shown. Accordingly, at T1 the cell current was adjusted to about 1.12 amps and continued for about 22 seconds to time T2. At T2 the cell current was increased to 2.25 amps and continued for 10 seconds to time T3. At T3 the cell current was increased to 3.37 amps and continued for 11 seconds to time T4. At T4 the cell current was increased to 4.5 amps and continued for 2.3 minutes to plate the wafer. V(Th) was not exceeded during the process. The plated wafer was uniform and had no burn-through of the seed layer.

When a copper seeded wafer as used above was plated using the prior art method shown in FIG. 5, a constant current of 4.5 amp was applied to the cell and burn-through of the seed layer was observed since the voltage of the cell peaked V(p) initially at a value above V(Th). The wafer produced using the method shown in FIG. 5 was commercially unacceptable and had to be discarded.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multistep electroplating process for electroplating a substrate containing a seed layer thereon with copper or other metal comprising the steps of:

inserting the substrate having the seed layer thereon to initiate metal plating into an electroplating apparatus comprising a metal plating solution, an anode and multiple cathode electrical perimeter contacts to the seed layer;

exposing the seed layer, anode and the perimeter contacts to the metal plating solution;

plating onto the seed layer and substrate by applying to the anode and cathode perimeter contacts for a first time period a voltage below a predetermined threshold voltage which was empirically determined to cause burn-through of the seed layer; and continuing the plating onto the plated substrate by applying after the first time period a current to the anode and cathode perimeter contacts for a second time period the current producing a voltage below the predetermined threshold voltage.

2. The process of claim 1 wherein the substrate is a semiconductor wafer.

3. The process of claim 2 wherein the metal plating solution is a copper plating solution.

4. The process of claim 1 wherein the voltage during the first time period is constant and the current after the first period is constant.

5. The process of claim 1 wherein a seal is positioned over the contacts.

6. A multistep electroplating process for electroplating a substrate containing a seed layer thereon with copper or other metal comprising the steps of:

inserting the substrate having the seed layer thereon to initiate metal plating into an electroplating apparatus comprising a metal plating solution, an anode and multiple cathode electrical perimeter contacts to the seed layer;

exposing the seed layer, anode and cathode perimeter contacts to the metal plating solution; and plating onto the seed layer and substrate by applying to the anode and cathode perimeter contacts a current preprogrammed to ramp up to a current value from a first current value which current produces during the ramping a voltage below a predetermined threshold voltage which was empirically determined to cause burn-through of the seed layer.

7. The process of claim 6 wherein the substrate is a semiconductor wafer.

8. The process of claim 7 wherein the metal plating solution is a copper plating solution.

9. The process of claim 6 wherein the current value at the end of the ramping is constant.

10. The process of claim 6 wherein a seal is positioned over the contacts.

11. An apparatus for electroplating a substrate containing a seed layer thereon with copper or other metal which is immersed in an electroplating bath comprises:

a tank containing a metal plating solution;

an anode in the metal plating solution;

a substrate positioned in the metal plating solution having a seed layer thereon facing the anode, the seed layer having multiple cathode perimeter electrical contacts;

means for supplying a current to the anode and cathode perimeter electrical contacts in the apparatus to provide to the anode and perimeter contacts for a first time period a voltage below a predetermined threshold voltage which was empirically determined to cause burn-through of the seed layer; and means for supplying after the first time period a current to the anode and perimeter contacts for a second time period the current producing a voltage below the predetermined threshold voltage;

wherein when the current is supplied the metal of the metal plating solution is plated onto the seed layer forming a metal plated substrate.

12. The apparatus of claim 11 wherein the substrate is a semiconductor wafer.

13. The apparatus of claim 12 wherein the tank comprises an oveflow tank and an electrolytic cell within the overflow tank.

14. The apparatus of claim 11 wherein the contacts are sealed.

15. An apparatus for electroplating a substrate containing a seed layer thereon with copper or other metal comprises:

a tank containing a metal plating solution;

an anode in the metal plating solution;

a substrate positioned in the metal plating solution having thereon a seed layer facing the anode, the seed layer having multiple cathode perimeter electrical contacts; and means for supplying a current to the anode and cathode perimeter contacts which current is preprogrammed to ramp up to a current value from a first current value and which current produces during the ramping a voltage below a predetermined threshold voltage which was empirically determined to cause burn-through of the seed layer;

wherein when the current is supplied the metal of the metal plating solution is plated onto the seed layer forming a metal plated substrate.

16. The apparatus of claim 15 wherein the substrate is a semiconductor wafer.

17. The apparatus of claim 16 wherein the tank comprises an overflow tank and an electrolytic cell within the tank.

18. The apparatus of claim 15 wherein the contacts are sealed.

* * * * *